United States Patent [19]

Kahn

[11] Patent Number: 4,653,095

[45] Date of Patent: Mar. 24, 1987

[54] AM STEREO RECEIVERS HAVING PLATFORM MOTION PROTECTION

[76] Inventor: Leonard R. Kahn, 137 E. 36th St., New York, N.Y. 10016

[21] Appl. No.: 826,717

[22] Filed: Feb. 6, 1986

[51] Int. Cl.[4] ..... H04H 5/00

[52] U.S. Cl. ..... 381/15; 381/13; 329/136; 329/146; 455/304

[58] Field of Search ..... 381/15, 16, 13; 455/42, 455/50, 52, 61, 63, 307, 304; 329/123, 124, 135, 136, 145, 146, 147

[56] References Cited

U.S. PATENT DOCUMENTS

| | | | |
|---|---|---|---|
| 4,192,970 | 3/1980 | Kahn | 455/307 X |
| 4,379,208 | 4/1983 | Isbell et al. | 381/15 |
| 4,383,136 | 5/1983 | Numata et al. | 381/15 |
| 4,426,728 | 1/1984 | Kahn | 381/15 |
| 4,489,431 | 12/1984 | Ecklund | 381/15 |

*Primary Examiner*—Forester W. Isen

*Attorney, Agent, or Firm*—Edward A. Onders; Frank R. Agovino

[57] ABSTRACT

Certain, but not all AM stereo radio broadcasting and reception systems suffer from a severe form of reception anomaly wherein the perceived stereo image moves from side to side, back and forth, which effect has come to be known as "Stereo Platform Motion" or simply "Platform Motion". A prior art patent proposed a method for sensing reception conditions conductive to Platform Motion and then switching the receiver from stereo to monophonic reception to avoid Platform Motion. The present invention enables the AM stereo receiver to maintain stereo operation under such reception conditions, and instead of switching the receiver to monophonic operation, it switches the receiver to a different method of stereo reception that does not suffer from Platform Motion.

7 Claims, 4 Drawing Figures

AM STEREO RECEIVERS HAVING PLATFORM MOTION PROTECTION

BACKGROUND OF THE INVENTION

This invention relates to the field of AM stereo reception and, more particularly, to AM stereo receivers which include means for protecting reception from producing undesired side-to-side motion in the perceived stereo image (Platform Motion).

Platform Motion is an inherent characteristic of AM Stereo systems which utilize the phase relationship between the broadcast carrier and its sidebands to represent stereo difference (L−R) information. Such systems are called "phase separation" type systems in this specification. Phase separation AM stereo systems include AM/PM, AM/FM and quadrature modulation systems, including the pure quadrature amplitude modulation (QUAM) system, as proposed at one time by the Harris Corporation, and the so called compatible quadrature amplitude modulation system proposed by Motorola Inc. (the "Motorola system").

Platform Motion can result from several causes, one of which is co-channel interference (i.e., interference caused by the reception of two or more signals (a desired signal and one or more undesired signals) having almost identical carrier frequencies.

Co-channel interference produces a carrier beat between the desired and undesired signals. This introduces a resultant carrier wobble. Also, and more importantly, for medium and low level interference, the sidebands of the undesired or interfering signal swing in phase around the carrier of the stronger desired signal. In phase separation AM stereo systems the result is that the interference itself moves from side-to-side in the perceived stereo image, increasing the annoyance factor of the co-channel interference.

On the other hand, AM stereo systems that use the frequency difference between the upper and lower sidebands of the broadcast signal to represent stereo information [i.e., the Kahn/Hazeltine Independent Sideband (ISB) System where, for example, left stereo information is transmitted via the lower sideband and right stereo information via the upper sideband] do not suffer from Platform Motion.

U.S. Pat. No. 4,489,431, which issued to L. M. EcKlund, (the '431 Patent) discloses circuitry for use in AM stereo receivers for the Motorola system to avoid the annoying effects of Platform Motion. The '431 Patent's solution to the Platform Motion problem is to detect the presence of co-channel interference and switch the AM stereo receiver to monophonic operation when co-channel interference occurs. While this simple solution eliminates Platform Motion, it also obviously eliminates stereo reception at the same time, thereby reducing the stereo coverage of the desired AM station involved. Thus, those AM broadcast stations which use the Motorola AM stereo system and which suffer from Co-channel interference will have their stereo coverage significantly reduced.

The means for detecting co-channel interference disclosed in the '431 Patent may be used as part of AM stereo receivers which embody the present invention and, therefore, the specification and drawings of the '431 Patent are incorporated herein by reference.

It is, therefore, an object of the present invention to prevent co-channel interference from causing Platform Motion in AM stereo receivers for phase separation AM stereo systems, such as the Motorola system, while not switching such receivers to monophonic operation.

It is a further object of the invention to provide improved AM stereo receivers which avoid loss of stereo coverage for AM stations which use phase separation AM stereo systems and which are subject to co-channel interference.

SUMMARY OF THE INVENTION

In accordance with the present invention, there is provided an AM stereo receiver having protection from Platform Motion. Such receiver includes means for receiving AM radio frequency (RF) signals and for converting said signals to corresponding intermediate frequency (IF) signals. Such receiver also includes means, responsive to the IF signals, for decoding AM stereo signals according to at least two different modes of operation, at least one of which is subject to Platform Motion under certain signal reception conditions and another of which is relatively immune from Platform Motion under such signal reception conditions. Such receiver also includes means for detecting the existance of the aforementioned signal reception conditions. Finally, such receiver includes means, responsive to the output of the aforementioned detecting means, for causing the AM stereo signal decoding means to change to that one of its operating modes which is immune from Platform Motion whenever the detecting means indicates that such certain signal reception conditions exist.

For a better understanding of the present invention, together with other and further objects, reference is made to the following description, taken in conjunction with the accompanying drawings, and its scope will be pointed out in the appended claims.

DESCRIPTION OF THE INVENTION

Figures 1A, 1B:
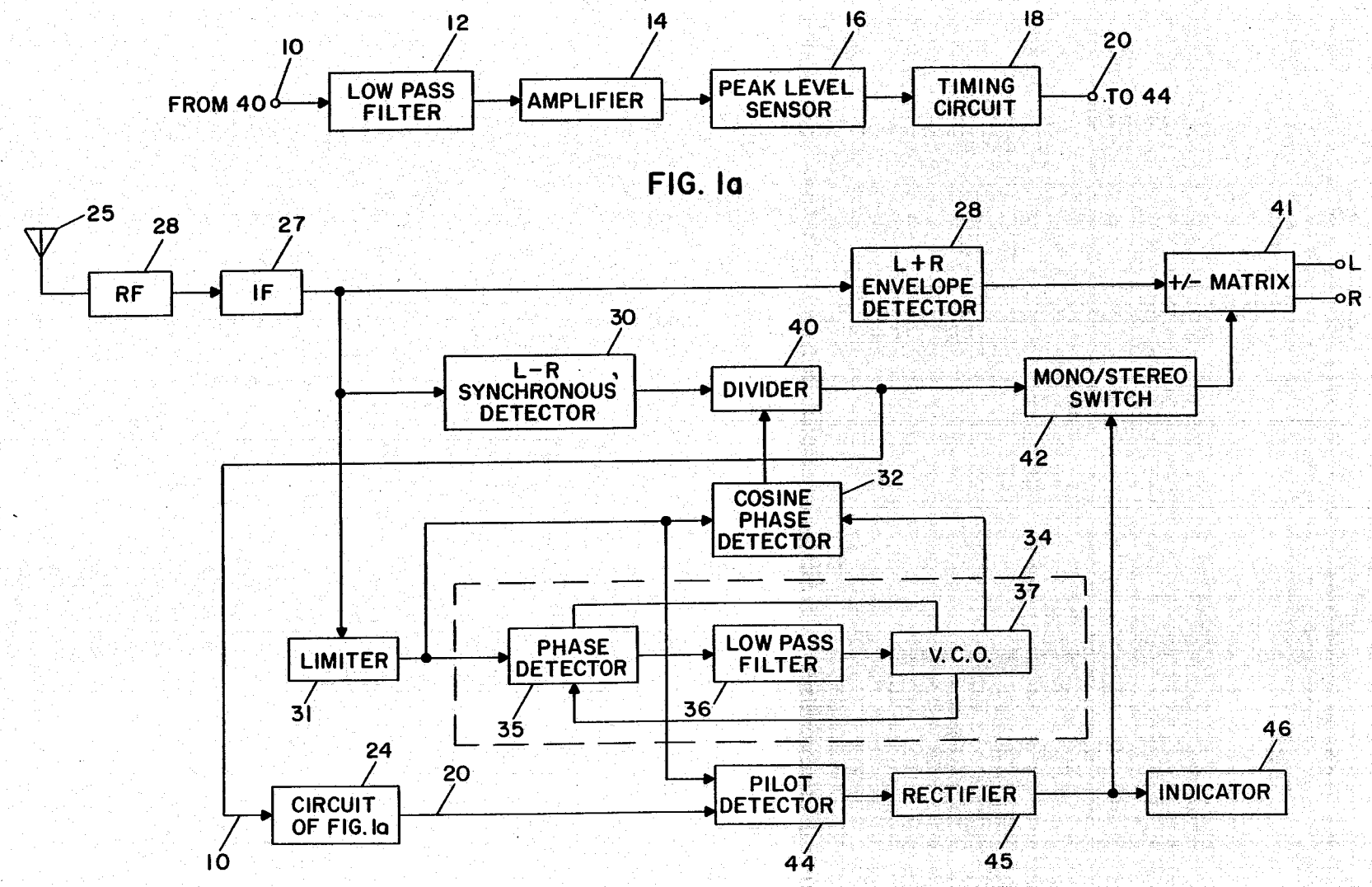
FIGS. 1A and 1B are copied from prior art U.S. Pat. No. 4,489,431, where FIG. 1A corresponds to FIG. 1 of the '431 Patent and FIG. 1B corresponds to FIG. 2 of the '431 Patent.

The circuitry of FIG. 1, and its operation, are described in prior art U.S. Pat. No. 4,489,431. However, the specific method used in the '431 Patent to detect the presence of co-channel interference in an AM stereo receiver for phase separation type AM stereo broadcasts is not intended to limit the present invention. The '431 Patent's disclosure is used merely as a convenient illustration of one form of co-channel interference detection circuitry usable with the present invention. It should be noted that block 41 of FIG. 1B has been renamed "+/− Matrix" instead of "Stereo Decoder" which is the erroneous label used for block 41 in FIG. 2 of the '431 Patent. The term "stereo decoder" as used in the present specification means the overall stereo signal decoder portion of an AM stereo receiver, and not merely the sum and difference marix (+/− Matrix) portion thereof.

In the '431 Patent, the method for sensing certain reception conditions which cause Platform Motion in AM stereo receivers for phase separation AM stereo systems, such as the Motorola system, is to detect low frequency beats caused by co-channel interference. An alternative simpler method is to merely sense low received signal level conditions as will be indicated, for example, by the AGC voltage of the stereo receiver. If the received signal is weak, one can usually expect that significant co-channel interference will be experienced. Using either method, if the existance of co-channel interference is indicated, in accordance with the present invention the stereo decoding mode of the AM stereo receiver should be changed from the phase separation system mode to the independent sideband reception system mode, which is relatively immume to Platform Motion. Use of the AGC voltage fed to a simple threshold sensing device would generally be simpler and less expensvie than use of the co-channel interference detection method disclosed in the '431 Patent and, accordingly, is one of the preferred embodiments of the present invention.

There are a number of uses for the present invention. For example, the invention can be used with;

(a) Single-system AM stereo receivers for phase separation type AM stereo systems, such as the Motorola system; or (b) Multi-system AM stereo receivers which are designed to receive both phase separation type AM stereo signals and frequency separation type AM stereo signals, and which switch to monophonic reception when no AM stereo pilot signals are received for either system; or (c) Multi-system AM stereo receivers which are designed to receive both phase separation type AM stereo signals and frequency separation type AM stereo signals, and which switch to phase separation type reception only when receiving the pilot signal of a phase separation system, but which switch to frequency separation type reception when receiving either monophonic signals (i.e. no pilot signals) or when receiving the pilot signal of a frequency separation type AM stereo broadcast.

Figure 2:
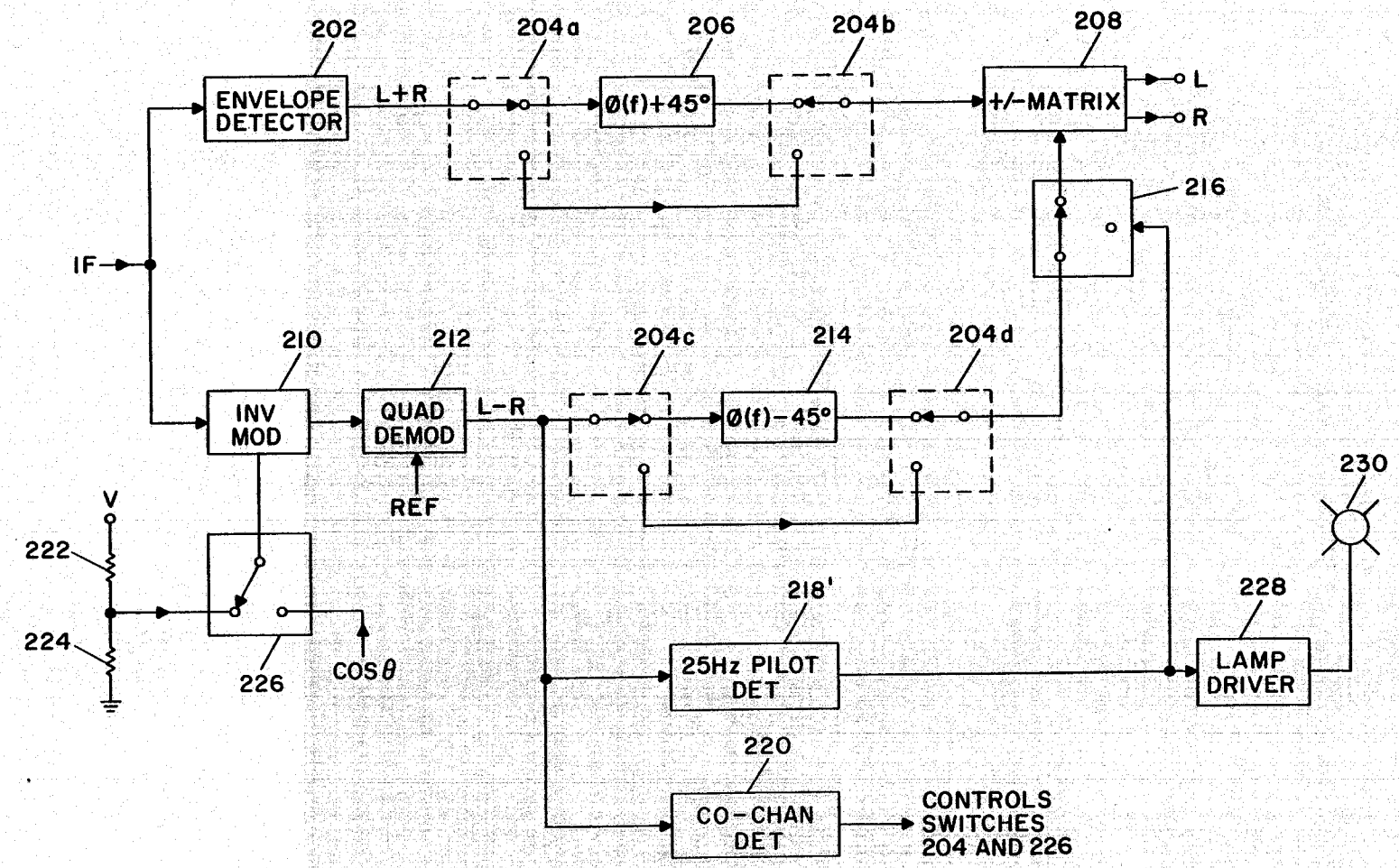
FIG. 2 shows a simplified block diagram of a single-system AM stereo receiver which embodies the present invention.

FIG. 2 shows a single-system type AM stereo receiver embodying the present invention. In this example the single AM stereo system is the Motorola compatible quadrature amplitude modulation system, and the stereo decoding circuitry is based upon that disclosed in U.S. Pat. No. 4,371,747, which issued to F. H. Hilbert, (the '747 Patent) for deriving a cos ($\theta$) correction—(see FIG. 1 of the '747 Patent) and upon my prior U.S. Pat. No. 4,018,994 (the '994 Patent) for the method of reducing distortion in the demodulated L−R signal by use of inverse amplitude modulation, in this case with a cos ($\theta$) correction signal derived from the L+R component of the received signal. Unfortunately, the Motorola system is a phase separation AM stereo system and, therefore, without the present invention the receiver of FIG. 2 would suffere from Platform Motion when operating in stereo. It also is subject to enhancement of certain noise peaks due to the cos ($\theta$) correction required for the Motorola AM stereo system. A method for reducing this noise problem is disclosed in U.S. Pat. No. 4,169,968, which issued to N. W. Parker, (i.e., to switch off the cos ($\theta$) correction when the input signal-to-noise ratio drops below a certain value of high frequency noise. In the present case the cos ($\theta$) correction may also be disabled (by switching to a fixed bias) when the co-channel interference level exceeds a threshold point and the Platform Motion protection feature is switched into the stereo decoder circuitry.

Referring to FIG. 2 which shows a block diagram of one embodiment of the present invention, the single-system (Motorola system) AM stereo decoder shown accepts a supplied IF signal such as would be supplied from a conventional AM receiver front end, such as blocks 25, 26 and 27 of FIG. 1*b*. The L+R signal developed at the output of envelope detector 202 feeds section (a) of electronic switch 204.

With switch 204 in the position shown in FIG. 2, the platform motion protection feature is activated. Thus, the L+R signal from envelope detector 202 is coupled to one input of the sum and difference (+/− matrix) 208 via all-pass phase shift network 206, while at the same time the L−R signal from quadrature demodulator 212 is coupled to the other input of matrix 208 via phase shift network 214 and electronic switch 216. The pair of networks 206 and 214 provide a phase difference of approximately 90 degrees over at least a substantial portion of the audio response range of the receiver. For additional details on the theory and design of such networks, refer to "Normalized Design of 90 Phase Difference Network" by S. D. Bedrosian, IRE Transactions of the Professional Group on Circuit Theory, Vol. CP-7, No. 2, pages 128–136, June 1960, and the bibliographical references contained therein.

An L−R signal is derived using circuitry which may follow the disclosures of the '747 Patent and the '994 Patent, including inverse modulator 210 and quadrature demodulator 212. As noted above, an electronic switch 226 may be inserted in the control input to inverse modulator 210 for switching from the cos ($\theta$) correction signal, in one embodiment of this invention, to a fixed bias developed from a voltage divider formed by resistors 222 and 224 and voltage source E. Electronic switch 226 is shown in the noise reduction position, since switches 204 and 216 of FIG. 2 are all shown in the position where a 25 Hz stereo pilot signal is received and co-channel interference, above a certain threshold, is detected. The output of inverse modulator 210 feeds quadrature demodulator 212, which is also fed a reference signal corresponding to the received IF carrier wave displaced by 90 degrees.

The output signal from quadrature demodulator 212 includes an L−R signal component and, in the case of reception of an AM station broadcasting in accordance with the Motorola AM stereo system as described in the '431 Patent, also includes a 25 Hz pilot signal component. When the 25 Hz tone is detected by pilot detector 218', it causes electronic switch 216 to couple the L−R signal available at the output of switch section **204*d* to +/− Matrix 208. In the present case the L−R signal has been phase shifted by phase shift network 214, since the (c) and (d) sections of switch 204** are shown in the Platform Motion protection position.

When co-channel interference is present, then the signal out of quadrature detector 212 will also include a low frequency beat component. This beat component is detected in co-channel detector 220 which, for example, can be implemented by using the circuitry which is disclosed in the '431 Patent for this purpose. The output signal from detector 220 controls switches 204 and 226. It is possible to implement the arrangement shown in FIG. 2 without including switch 226 and the voltage divider 222 and 224, but at the penalty of higher noise levels in the L−R signal at the output of quadrature demodulator 212 under adverse signal reception conditions.

When the co-channel interference is below a level which will cause perceptible Platform Motion, the output of detector 220 will cause switches 204 and 226 to switch back to the normal Motorola system reception mode, without the phase shift networks 206 and 214 in the L+R and L−R signal paths and with the cos (θ) control signal coupled to the control input of inverse modulator 210.

Stereo indicator lamp 230 is controlled by the output of 25 Hz pilot detector 218' via lamp driver 228. When no 25 Hz pilot is detected (such as during reception of a monophonic AM broadcast), lamp 230 is not lit and switch 216 is open so that no L−R signal is coupled to the second input of Matrix 208.

Figure 3:
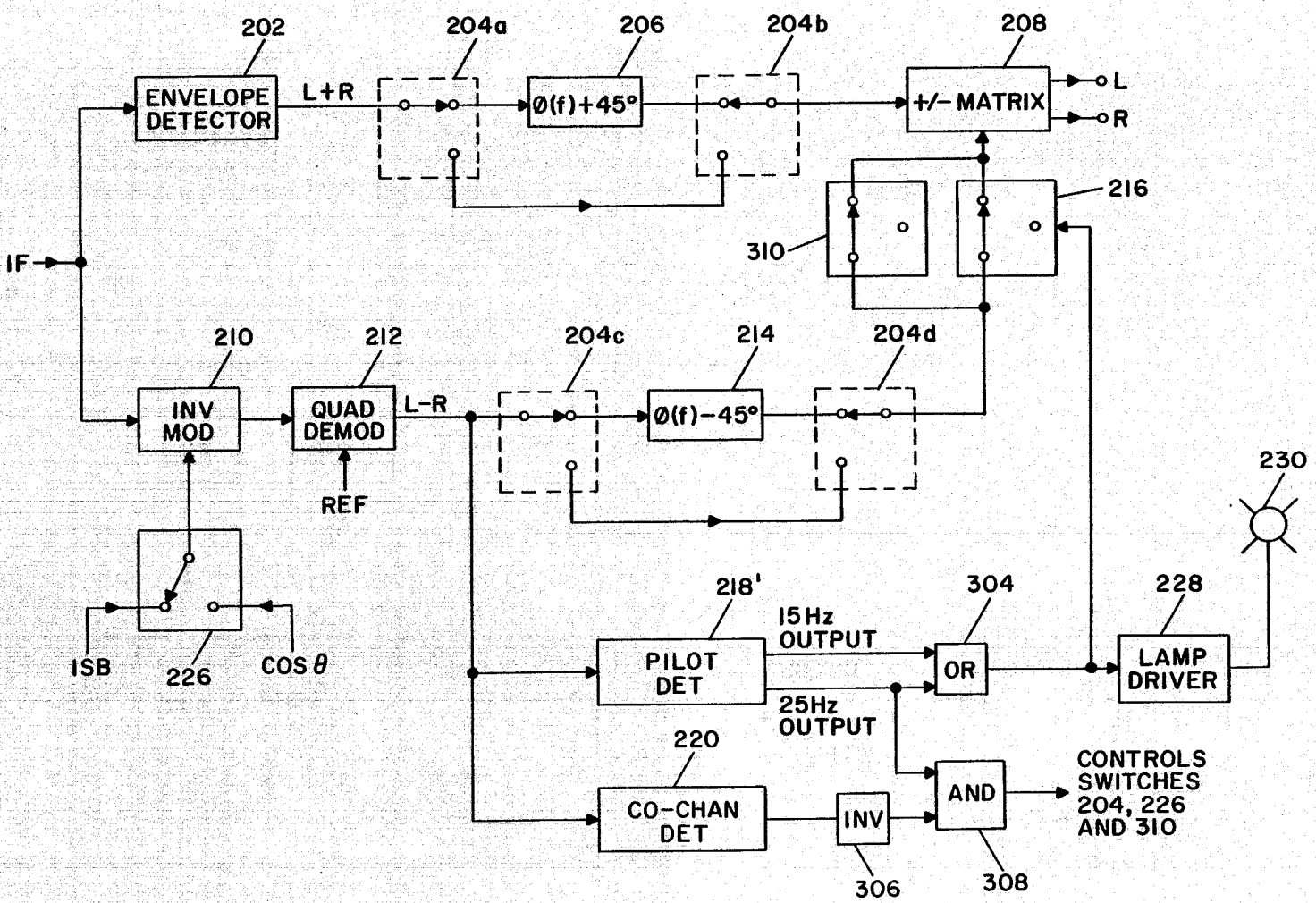
FIG. 3 shows a simplified block diagram of a multi-system AM stereo receiver which embodies the present invention.

FIG. 3 shows a multiple-system or multi-system AM stereo receiver embodiment of the present invention. Multi-system AM stereo receivers are known in the art from my prior U.S. Pat. No. 4,426,728. In the present case, circuitry is provided to cause the multi-system receiver of FIG. 3 to operate in any one of three different modes: (1) monophonic reception, (2) stereo reception in accordance wtih the Motorola system, or (3) stereo reception in accordance with the Kahn/Hazeltine independent sideband (ISB) system.

Many of the blocks shown in FIG. 3 bear the same reference numbers as corresponding blocks shown in FIG. 2 and these operate in the same manner as has been described above in connection with the description of the embodiment of FIG. 2.

However, switch 226 instead of switching between the cos (θ) correction signal and a fixed bias, switches between the cos (θ) correction signal and an ISB correction signal, for proper ISB operation in accordance with the '994 Patent for example.

Furthermore, a pilot signal detector 218', which senses both 15 Hz pilots and 25 Hz pilots, is provided. Alternatively, two separate pilot signal detectors can be used. The two outputs of pilot detector 218' feed OR circuit 304 which, in turn, feeds the stereo lamp driver 228 and also switch 216.

Electronic switch 216 can switch the receiver to monophonic operation, as described previously, in the absense of either a 15 Hz pilot or a 25 Hz pilot. However, in many applications it may be preferable to provide only two modes of operation; i.e., (1) Motorola system operation (with phase shift networks 206 and 214 switched out of the L+R and L−R signal paths, and with the cos (θ) correction signal applied to the control input of inverse modulator 210) when a 25 Hz pilot tone is detected and favorable signal reception conditions exist; and (2) ISB, or Kahn/Hazeltine system, operation for all other conditions, such as reception of:

(a) Kahn/Hazeltine system stereo signals (indicated by the presence of a 15 Hz pilot tone); or (b) monophonic signals (no pilot tone); or (c) Motorola system stereo signals (indicated by the presence of a 25 Hz pilot tone) during unfavorable signal reception conditions, such as when the received signal is weak or suffers from co-channel interference.

For this two mode operation, switch 310 may be used to disable switch 216, or switches 310 and 216 can be deleted, in which case the output of switch 204d should be connected directly to the input of Matrix 208. Similarly, in FIG. 2 switch 216 can be deleted and sections (a), (b), (c) and (d) of switch 204 can be caused to introduce the phase difference networks 206 and 214 whenever monophonic signals are received or when Motorola system signals are received under unfavorable signal reception conditions (e.g. those which would cause Platform Motion).

Returning to FIG. 3, the 25 Hz output of detector 218' feeds AND circuit 308. Also feeding block 308 is the output of inverter 306, providing an inverted output from co-channel detector 220. Thus, if co-channel interference is present but is below detector 220's threshold and a 25 Hz pilot is detected, AND circuit 308 produces a "1" output, causing sections (a), (b), (c) and (d) of switch 204 to switch the phase difference networks 206 and 214 out of the L+R and L−R signal paths and causing switch 226 to apply the cos (θ) correction signal to inverse modulator 210. On the other hand, if either the 25 Hz pilot is missing or co-channel interference is detected, a "0" output signal is produced by AND circuit 308, thereby switching phase shift networks 206 and 214, into the L+R and L−R signal paths and applying the ISB correction signal to inverse modulator 210.

In the above embodiments of the invention, switch 204 is shown as changing the stereo signal decoder from one mode of operation to another by inserting or removing the 90 degree phase difference networks 206 and 214. In a preferred embodiment of the invention, instead of switching in or out the phase difference networks (thereby rapidly introducing or removing the 90° phase difference), 90 degrees of phase difference would be gradually introduced or removed (over a few second interval for example) so that listeners would not hear a sudden change in the stereo image. During this blending process, the relative phase difference between the L−R and L+R signals would be increased slowly in small discrete steps, or continuously from 0° to 90°, or vice versa.

While there have been described what are presently believed to be the preferred embodiment of the invention, those skilled in the art will recognize that other and further modifications may be made thereto without departing from the spirit of the invention and it is intended to claim all such changes and modifications as fall within the true scope of the invention.

I claim:

1. An AM stereo receiver having protection from Platform Motion, comprising:

first means for receiving AM radio frequency (RF) signals and for converting said signals to corresponding intermediate frequency (IF) signals;

second means, responsive to said IF signals, for decoding AM stereo signals according to at least two different modes of operation, at least one of which is subject to Platform Motion under certain signal reception conditions and another of which is immune from Platform Motion under said signal reception conditions;

third means for detecting the existance of said certain signal reception conditions and for developing an output indication thereof;

fourth means, responsive to the output of said detecting means, for causing said AM stereo signal decoding means to operate in that one of its operating modes which is immune from Platform Motion whenever said detecting means indicates that said certain signal reception conditions exist.

2. The AM stereo receiver of claim 1 wherein said AM stereo signal decoding means is capable of operating in a first mode for decoding phase separation AM stereo system signals.

3. The AM stereo receiver of claim 2 wherein said AM stereo signal decoding means is capable of operating in a second mode for decoding independent sideband AM stereo system signals, said second mode being immune from Platform Motion.

4. The AM stereo receiver of any one of the preceding claims wherein said phase separation system is the Motorola compatible quadrature amplitude modulation system.

5. The AM stereo receiver of claim 3 wherein said detecting means detects the presence of co-channel interference beats in the received signal.

6. The AM stereo receiver of claim 3 wherein said detecting means detects when the received signal is below a predetermined level.

7. The AM stereo receiver of any one of the preceding claims 2, 3, 5 or 6 wherein said receiver includes means for detecting the presence of a pilot signal which is transmitted with and uniquely identifies said phase separation system signals and for developing an output indicative thereof;

and wherein said fourth means is also responsive to the output of said pilot signal detecting means and causes said AM stereo signal decoding means to also operate in that one of its operating modes which is immune from Platform Motion when said pilot signal detecting means indicates that said pilot signal is not being received.

* * * * *